United States Patent [19]

Neuroth

[11] Patent Number: 4,791,246

[45] Date of Patent: Dec. 13, 1988

[54] POWER CABLE USEFUL IN SEISMIC TESTING

[75] Inventor: David H. Neuroth, Hamden, Conn.

[73] Assignee: Hubbell Incorporated, Orange, Conn.

[21] Appl. No.: 86,636

[22] Filed: Aug. 19, 1987

[51] Int. Cl.[4] ..... H01B 7/22

[52] U.S. Cl. ..... 174/102 R; 174/105 R; 174/109; 174/117 F; 174/128.1; 174/131 R

[58] Field of Search ..... 174/102 R, 105 R, 109, 174/117 F, 131 R, 128 R, 70 R

[56] References Cited

U.S. PATENT DOCUMENTS

| | | | |
|---|---|---|---|
| 2,690,984 | 10/1954 | Crandall et al. | 174/107 |
| 3,291,898 | 12/1966 | Sandell | 174/109 |
| 3,324,233 | 6/1967 | Bryant | 174/131 R |
| 3,549,788 | 12/1970 | Apen | 174/117 F X |
| 3,832,481 | 8/1974 | Boyd et al. | 174/102 R |
| 4,158,185 | 4/1979 | Dageforde et al. | 174/128 R X |
| 4,262,703 | 4/1981 | Moore et al. | 138/115 |
| 4,315,099 | 2/1982 | Gerardot et al. | 174/47 |
| 4,374,530 | 2/1983 | Walling | 138/110 |
| 4,467,138 | 8/1984 | Brorein | 174/117 F X |
| 4,490,577 | 12/1984 | Neuroth | 174/103 |
| 4,572,926 | 2/1986 | Ganssle et al. | 174/103 |
| 4,644,094 | 2/1987 | Hoffman | 174/47 |
| 4,675,474 | 6/1987 | Neuroth | 174/102 R |

FOREIGN PATENT DOCUMENTS

| | | |
|---|---|---|
| 0060061 | 9/1982 | European Pat. Off. . |
| 0066910 | 12/1982 | European Pat. Off. . |
| 1250823 | 10/1971 | United Kingdom . |

*Primary Examiner*—Morris H. Nimmo

*Attorney, Agent, or Firm*—Roylance, Abrams, Berdo & Goodman

[57] ABSTRACT

A self-supporting power cable which is especially useful in seismic testing. The cable includes an outer armor layer, a pair of tensile elements located inside the armor layer, a power conveying assembly located inside the armor layer and between the tensile elements, and filler material filling the otherwise empty spaces within the armor layer. The tensile elements are advantageously formed of several concentric layers of spirally-wrapped wire strands with at least the outer layer having less than a full contingent of strands. This improves the cable's strength-to-weight ratio while providing self support. To provide transverse force resistance against the cleats of a feeding device, the outer layer of the wire ropes contact the walls of the outer armor layer.

17 Claims, 2 Drawing Sheets

POWER CABLE USEFUL IN SEISMIC TESTING

FIELD OF THE INVENTION

The invention relates to a power cable which is especially useful in seismic testing. The cable is self-supporting, has a high strength-to-weight ratio, and resists transverse compressive forces. This is accomplished by using a pair of tensile elements, each formed of several concentric layers of spirally-wrapped wire strands with at least the outer layer having less than a full contingent of strands.

BACKGROUND OF THE INVENTION

Power cable of great lengths, on the order of 10,000–15,000 feet, are used in seismic testing operations. In particular, this cable is suspended in an oil well and has seismographic analytical equipment at the end to assist in locating oil bearing rock formations. Typically, this power cable is fed into the open well and removed therefrom via opposed tractor feeding mechanisms comprising a pair of spaced parallel belts having a series of cleats thereon which grip diametrically opposed sides of the cable. An example of this feeding device is disclosed in U.S. Pat. No. 3,285,485 to Slator, the disclosure of which is hereby incorporated herein by reference.

While many attempts have been made to provide optimum power cable for use in seismic testing, numerous disadvantages are present in these prior power cables. Thus, many of these cables are not self-supporting and thus require additional tubing or other supports thousands of feet long. In addition, many of these prior power cables are extremely heavy, and thus are difficult to work with and costly to make. Moreover, many of these power cables do not have significant resistance to transverse compressive forces created by the normal forces of the cleats on the tractor feeding devices.

Examples of these prior power cables are disclosed in the following U.S. Pat. Nos.: 2,690,984 to Crandall et al; 4,262,703 to Moore et al; 4,315,099 to Gerardot et al; 4,374,530 to Walling; 4,490,577 to Neuroth; 4,572,926 to Ganssle et al; and 4,644,094 to Hoffman, the disclosures of which are hereby incorporated herein by reference. In addition, prior power cables are disclosed in U.K. Pat. No. 1,250,823 to Spencer and European patent applications 0060061 to Walton and 0066910 to Baldoni. Power cables are also disclosed in pending, commonly assigned U.S. patent applications Ser. No. 896,011 filed on Aug. 13, 1986 in the names of Ernest G. Hoffman and David H. Neuroth, and Ser. No. 937,009 filed on Dec. 2, 1986 in the names of Ernest G. Hoffman and David H. Neuroth.

SUMMARY

Accordingly, a primary object of the invention is to provide a power cable useful in seismic testing which is self-supporting, has a high strength-to-weight ratio and resists tranverse compressive forces.

Another object of the invention is to provide a power cable that is self-supporting via a pair of tensile elements in the form of wire ropes.

Another object of the invention is to provide a power cable that has a high strength-to-weight ratio and is less costly to make than prior devices due to the use of tensile elements formed of several layers of spirally-wrapped wire ropes with at least the outer layer having less than a full contingent of strands.

A further object of the invention is to provide a power cable that resists transverse compression forces by engaging a pair of wire ropes with the inner surface of an outer armor layer.

The foregoing objects are basically attained by providing a power cable, the combination comprising: an outer armor layer having a longitudinal axis Z, orthogonal transverse axes X and Y, and a cavity defined therein having a height in the Y direction of A; a pair of tensile elements located in the cavity, extending along the Z axis, and spaced apart along the X axis, each of the tensile elements including an inner tensile member, and an outer tensile member, the outer tensile member including one pair of strands spirally wrapped about the inner tensile member, the strands in the pair being circumferentially spaced from one another through substantially 180°, the outer tensile member having circumferential gaps therein, and the strands having outer edges separated by a distance substantially equal to A; a power conveying assembly located in the cavity, extending along the Z axis, and positioned between the pair of tensile elements; and filler material located in the cavity and substantially filling any otherwise empty spaces therein.

Other objects, advantages and salient features of the invention will become apparent from the following detailed description, which, taken in conjunction with the annexed drawings, discloses preferred embodiments of the invention.

DRAWINGS

Referring now to the drawings which form a part of this original disclosure:

DETAILED DESCRIPTION OF THE INVENTION

Figure 1:
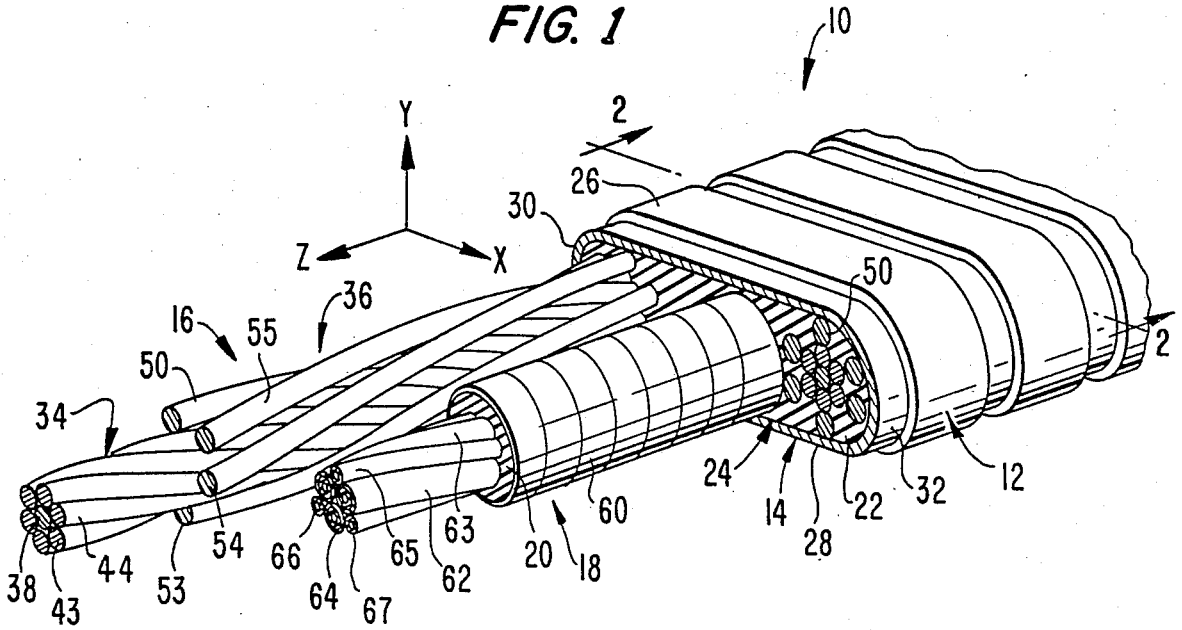
FIG. 1 is a fragmentary right perspective view with parts broken away of the power cable in accordance with the invention.
Figure 2:
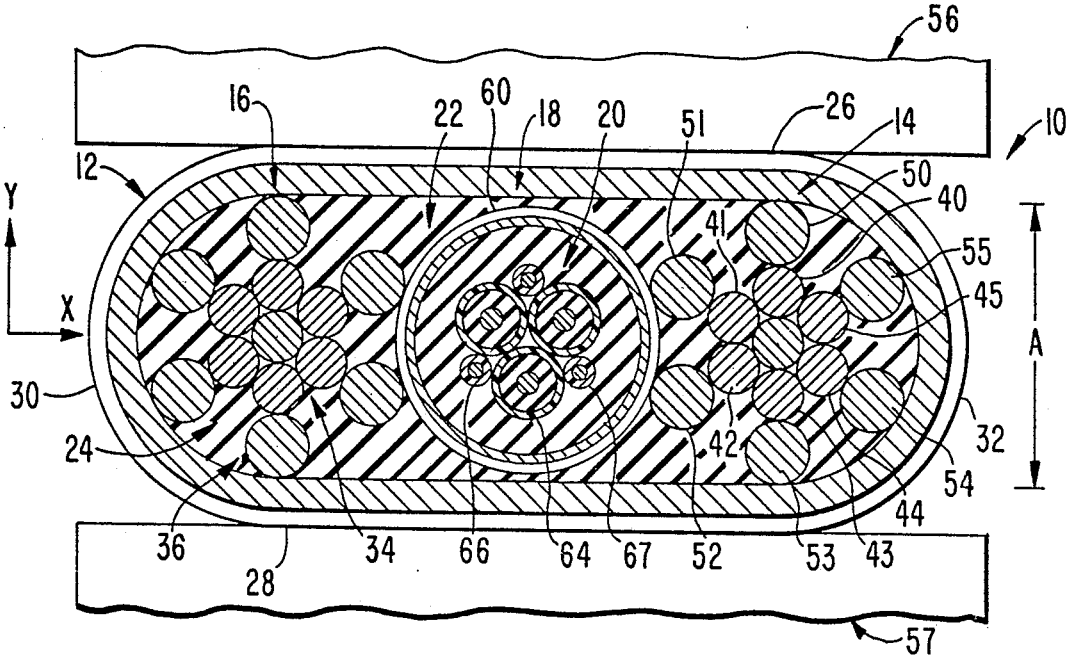
FIG. 2 is an enlarged elevational view in transverse section of the power cable shown in FIG. 1 taken along line 2—2 in FIG. 1 with the addition of a pair of opposed cleats shown in fragmentary form from a typical tractor feeding device.

As seen in FIGS. 1 and 2, the power cable 10 in accordance with the invention comprises an outer armor layer 12, a pair of tensile elements 14 and 16, a power conveying assembly 18, filler material 20 in the power conveying assembly 18, and filler material 22 external to the power conveying assembly but inside the outer armor layer 12. As will be described in more detail hereinafter, each of the tensile elements 14 and 16 is formed from several layers of spirally-wrapped wire strands with the outer layer having less than a full contingent of strands. Advantageously, the outer layer of strands comprises an even number and are oriented in diametrically opposed pairs. By coordinating the bearing surface of the cleats on the feeding device and the angle of the spirally-wrapped outer layer strands, the cleats on the tractor feeding device engage each pair of diametrically opposed outer strands on the top and bottom of the cable. This transfers shear and transverse compressive forces to the central strands of the wire rope. This construction also improves engagement of the wire ropes with the rubber filler material due to the gaps between the outer strands, and optimizes the strength-to-weight ratio by eliminating some of the strands.

The outer armor layer 12 is advantageously in a flat configuration and is formed of a metal such as stainless steel in a spirally-wrapped configuration. The outer layer forms a continuous tube and defines an inner cavity 24 having a longitudinal axis Z and transverse orthogonal axes X and Y as seen in FIG. 1. This layer has a pair of parallel, substantially straight top and bottom walls 26 and 28 extending in the X direction and inwardly concave left and right side walls 30 and 32 extending in the Y direction. The space between the inner surfaces of the top and bottom walls 26 and 28 is shown as distance A in FIG. 2 and this is substantially equal to the distance between the outer edges of the outer spiral strands on the tensile elements 14 and 16 as will be described in more detail hereinafter. Thus, the inner surfaces of the top and bottom walls of the armor layer 12 contact these outer strands as seen in FIG. 2 and likewise the inner surfaces of the side walls 30 and 32 contact the outer strands. The radius of curvature of the left and right side walls is substantially the same and is substantially equal to the radius of curvature defined by the outer strands on the tensile elements.

The pair of tensile elements 14 and 16 are located in the cavity 24, extend along the Z axis and are spaced apart along the X axis. They are advantageously formed as wire ropes of solid cylindrical strands of steel and are therefore substantially rigid in the transverse directions. As seen in FIGS. 1 and 2, each tensile element comprises an inner tensile member 34 and an outer tensile member 36.

As seen most clearly in FIG. 2, the inner tensile member 34 comprises a straight, central strand 38 and six inner strands 40–45 spirally wrapped about the central strand 38. As seen in FIG. 2, there are no circumferential gaps between the adjacent strands 40–45 and they thus engage one another as well as the central strand 38. The cross sections of strands 40–45 are advantageously equal as shown and can be larger or smaller than the cross section of strand 38.

The outer tensile member 36 is advantageously formed from an even number of outer strands having the same cross section and comprises six outer strands 50–55 which are spirally wrapped about the inner tensile member 34 in an open, uniform helix with equal spacing therebetween. These six strands form three pairs comprising strands 50 and 53, 51 and 54, and 52 and 55, the strands in each pair being circumferentially spaced substantially 180° from the other. These outer strands 50–55 are less than the full contingent or complement of strands in the outer layer and thus form in the outer tensile member 36 a series of circumferential gaps between adjacent outer strands. The cross sections of strands 50–55 are shown larger than those of strands 38 and 40–45, but could be smaller.

Advantageously, the inner tensile members in each pair of tensile elements are oppositely sprially wrapped, as are the associated outer tensile members, to provide some balancing of the torque present due to the spiral wrapping. In essence, tensile elements 14 and 16 are mirror images of one another.

As seen in FIG. 2, the outer edges of strands 50 and 53, as well as strands 51 and 54, and 52 and 55, are separated by a distance of substantially A, which is the distance between the top and bottom walls 26 and 28 in the armor layer. Thus, these outer edges contact the inner surfaces of the top and bottom walls. This holds true for the other outer strands since they are in a spiral configuration and the inner tensile member has a substantially cylindrical outer surface. Likewise, along their spiral extent, each of the outer strands 50–55 contacts the adjacent inner surface of the left or right side walls 30 and 32 as illustrated in FIG. 2.

By eliminating some of the outer strands, the overall cable has a reduced weight and therefore for any given circumscribed diameter a higher strength-to-weight ratio. In addition, by using the wire ropes as the tensile elements, the cable 10 is self-supporting without placing tension on the power conveying assembly 18. Since the tensile elements 14 and 16 contact the outer armor layer, the transverse compressive forces placed on the cable in the Y direction and the shear forces placed on the cable in the Z direction by the cleats 56 and 57 in the tractor feeding device are transferred to and distributed among all the strands of the tensile elements.

The power conveying assembly 18 is also located in the cavity 24, extends along the Z axis, and is located between the tensile elements 14 and 16. Advantageously, the tensile elements contact the outer surface of the power conveying assembly. This is shown in FIG. 2 with strands 51 and 52 in each tensile element contacting the power conveying assembly 18.

This assembly 18 optionally includes an inner armor tubular layer 60 which is formed as a metallic spiral wrap and adds mechanical strength and resistance to decompressive forces to the overall cable. Located inside the armor layer 60 are a plurality of power conductors 62, 63 and 64. While shown as electrical power conductors or conveying lines, these also can be pneumatic or hydraulic lines or combinations of all three. Advantageously as shown, the power conductors 62–64 comprise solid copper conductors, rubber insulation and an outer layer of chemical resistant polymeric material. In addition to the power conductors, the power conveying assembly 18 includes instrumentation testing wires 65–67 which can provide connection between the surface and any seismic devices located at the end of the cable.

The filler material 20 is curable rubber and is located inside the inner armor layer 60 and fills any otherwise empty spaces within the inner armor layer. Likewise, the filler material 22 is a curable rubber and is located in the cavity 24 in the outer armor layer 12 and fills any otherwise empty spaces therein.

Since the outer strands 50–55 on the tensile elements 14 and 16 are spirally wrapped and have circumferential spaces therebetween, the filler material 22 enters these spaces and this aids in connecting the wire ropes to the outer armor layer and preventing relative movement therebetween.

Advantageously, the power cable 10 can be formed by placing the power conductors and testing wires together in an array shown in FIG. 2, covering this array with filler material 20 and then wrapping the inner armor layer 60 thereabout. Then, the power conveying assembly 18 formed thereby is placed between the tensile elements 14 and 16, this combination has filler material 22 placed therein and thereabout, and then the outer armor layer 12 is wrapped around the entire combination. This combination can then be heated and the filler material cured. During this curing, the filler material expands and fills any of the otherwise empty spaces in the outer surface of the inner armor layer, the inner surface of the outer armor layer, which has a spiral groove therein, and the spaces between the outer strands 50–55 on the tensile elements.

Since the outer strands 50–55 are of an even number, this means that each wire will always have another wire directly opposite it. When the cable is placed in a tractor feeding device, these oppositely disposed outer strands act to transfer pulling forces from the feeding device to all of the strands in the tensile elements. This is accomplished by coordinating the bearing surface of the cleats and the angle of the spirally-wrapped outer layer strands 50–55. In particular, the bearing surface of the cleats is greater than one lay length of the outer spiral strands. Therefore, every outer strand crosses the top of the tensile element and is opposite the cleats at least once. Typically, the bearing surface is 36 to 72 inches and the lay length is 6 to 10 inches. Thus, the bearing surface can be several times greater than one lay length.

Advantageously, power cable 10 has an overall width in the X direction of about 2.20 inches and an overall height in the Y direction of about 0.80 inch. Each tensile element 14 and 16 can comprise a steel wire rope of 11/16 inch in diameter, with each strand having a diameter of about 0.137 inch and the wire rope weighing about 0.677 pounds per foot.

EMBODIMENT OF FIG. 3

Figure 3:
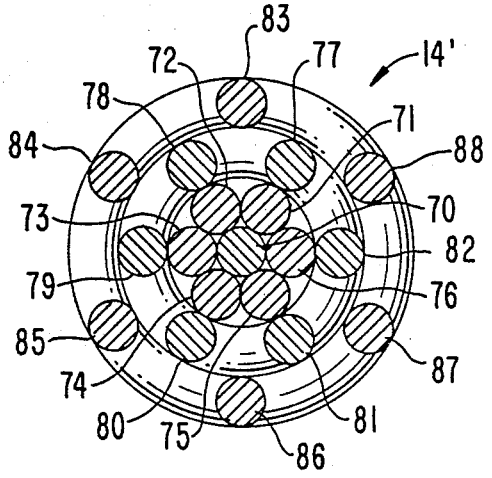
FIG. 3 is an enlarged transverse sectional elevational view of a modified tensile element that can be used in the power cable shown in FIG. 1.

In FIG. 3, a modified tensile element 14' is shown which can be used with the power cable shown in FIGS. 1 and 2. In this modified tensile element 14', four layers are used. The first is a central straight strand 70; the second layer is a spirally wrapped complete and continuous wire rope formed by inner strands 71–76; and the third layer is an intermediate layer formed by six intermediate strands 77–82 which have circumferential gaps and pairs of spaced circumferentially through about 180°. The final or outer layer comprises six outer strands 83–88 which are spirally wrapped about the intermediate strands and are circumferentially spaced and define pairs that are spaced through about 180°.

By using four layers, a larger diameter wire rope tensile element can be formed, but with the intermediate layer of strands 77–82 and the outer layer of strands 83–88 having less than their full contingent of strands, a reduction in weight is accomplished.

EMBODIMENT OF FIG. 4

Figure 4:
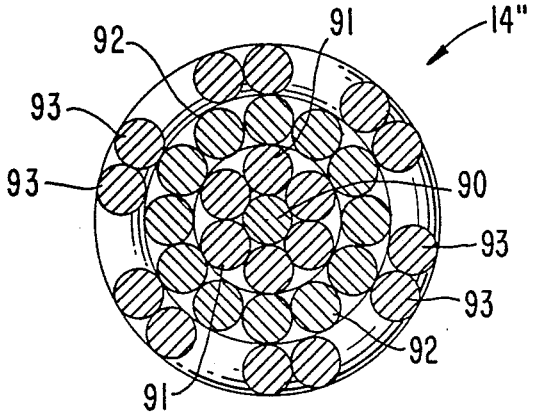
FIG. 4 is an enlarged transverse sectional elevational view of a second modified tensile element that can be used in the power cable shown in FIG. 1.

In FIG. 4, a second modified tensile element 14" is shown which can be used with the power cable 10 shown in FIGS. 1 and 2. In this modified tensile element 14" there are essentially five layers. The five layer is a straight central strand 90, and in the second layer there are six spirally-wrapped continuous inner strands 91 surrounding the central strand. Spirally wrapped about the inner strands 91 is the third layer comprising 12 intermediate strands 92, which completely surrounds strands 91 and have no circumferential gaps therebetween. Finally, in the fourth, outer layer, there are 12 outer strands 93 which are grouped in adjacent pairs, each pair having another pair located diametrically opposed therefrom. Thus, this outer layer formed by the outer strands 93 defines a spaced helix with one strand in a first pair being adjacent one strand in a second pair and the other of the strands in the first pair being adjacent the other of the strands in the second pair.

In this embodiment, weight reduction is obtained by limiting the number of outer strands, while significant strength is provided by using the central, inner and intermediate strands.

While various advantageous embodiments have been chosen to illustrate the invention, it will be understood by those skilled in the art that various changes and modifications can be made therein without departing from the scope of the invention as defined in the appended claims.

What is claimed is:

1. A power cable, the combination comprising:

an outer armor layer having a longitudinal axis Z, orthogonal transverse axes X and Y, and a cavity defined therein having a height in the Y direction of A;

a pair of tensile elements located in said cavity, extending along said Z axis, and spaced apart along said X axis, each of said tensile elements including an inner tensile member, and an outer tensile member, said outer tensile member including one pair of strands spirally wrapped about said inner tensile member, said strands in said pair being circumferentially spaced from one another through substantially 180°, said outer tensile member having circumferential gaps therein between said strands, and said strands having outer edges separated by a distance substantially equal to A;

power conveying means located in said cavity, extending along said Z axis, and positioned between said pair of tensile elements; and filler material located in said cavity and substantially filling any otherwise empty spaces therein, said outer armor layer having a top wall in contact with the outer edges of said strands in each of said outer tensile members, and a bottom wall in contact with the outer edges of said strands in each of said outer tensile members, said top and bottom walls extending transversely of said cavity along the X axis.

2. A power cable according to claim 1, wherein said outer armor layer is metallic.

3. A power cable according to claim 1, wherein said outer armor layer is formed as a spiral wrapping.

4. A power cable according to claim 1, wherein said outer armor layer top and bottom walls are substantially straight and parallel, said outer armor layer further including concave left and right side walls extending in the Y direction.

5. A power cable according to claim 1, wherein said outer armor layer has a left side wall in contact with the outer edges of said strands in one of said tensile elements, and a right side wall in contact with the outer edges of said strands in the other of said tensile elements.

6. A power cable according to claim 1, wherein each of said inner tensile members includes a spirally-formed wire rope.

7. A power cable according to claim 6, wherein each of said spirally-formed wire ropes includes a plurality of inner strands having circumferential gaps therebetween.

8. A power cable according to claim 6, wherein each of said spirally-formed wire ropes includes a central strand, a continuous set of inner strands spirally wrapped about said central strand, and a set of intermediate inner strands spirally wrapped about said continuous set and having circumferential gaps therebetween.

9. A power cable according to claim 6, wherein said outer tensile member further includes additional pairs of strands spirally wrapped about said inner tensile member, said strands in each of said additional pairs being circumferentially spaced from one another through substantially 180°, said strands in said additional pairs having outer edges separated by a distance substantially equal to A.

10. A power cable according to claim 1, wherein said outer tensile member further includes a second pair of strands spirally wrapped about said inner tensile member, said strands in said second pair being circumferentially spaced from one another through substantially 180°, said strands in said second pair having outer edges separated by a distance substantially equal to A, one of the strands in said pair being adjacent one of the strands in said second pair, and the other of the strands in said pair being adjacent the other of the strands in said second pair.

11. A power cable according to claim 1, wherein each of said strands comprises a solid wire.

12. A power cable according to claim 1, wherein said power conveying means comprises an inner armor layer.

13. A power cable according to claim 12, wherein said inner armor layer is formed as a metallic, spiral wrapping.

14. A power cable according to claim 12, wherein said inner armor layer contacts said pair of tensile elements.

15. A power cable according to claim 1, wherein each of said tensile elements is substantially rigid in the X and Y directions.

16. A power cable, the combination comprising:

an outer armor layer having a longitudinal axis Z, orthogonal transverse axes X and Y, and a cavity defined therein having a height in the Y direction of A;

a pair of tensile elements located in said cavity, extending along said Z axis, and spaced apart along said X axis, each of said tensile elements including an inner wire rope, and an outer wire rope, said outer wire rope including one pair of strands spirally wrapped about said inner wire rope, said strands in said pair being circumferentially spaced from one another through substantially 180°, said outer wire rope having circumferential gaps therein between said strands, and said strands having outer edges separated by a distance substantially equal to A and contacting said outer armor layer;

power conveying means located in said cavity, extending along said Z axis, and positioned between said pair of tensile elements; and filler material located in said cavity and substantially filling any otherwise empty spaces therein, said outer armor layer having a top wall in contact with the outer edges of said strands in each of said outer wire ropes, and a bottom wall in contact with the outer edges of said strands in each of said outer wire ropes, said top and bottom walls extending transversely of said cavity along the X axis.

17. A power cable according to claim 16, wherein said outer armor layer has a left side wall in contact with the outer edges of said strands in one of said tensile elements, and a right side wall in contact with the outer edges of said strands in the other of said tensile elements.

* * * * *